United States Patent [19]

Scheck et al.

[11] Patent Number: 4,516,792

[45] Date of Patent: May 14, 1985

[54] LATERALLY RELEASABLE TOE UNIT FOR A SKI SAFETY BINDING

[75] Inventors: Georg Scheck, Leonberg; Martin Bogner, Ostfildern, both of Fed. Rep. of Germany

[73] Assignee: GEZE GmbH, Fed. Rep. of Germany

[21] Appl. No.: 506,219

[22] Filed: Jun. 21, 1983

[30] Foreign Application Priority Data

Aug. 13, 1982 [DE] Fed. Rep. of Germany ..... 3230187

[51] Int. Cl.[3] ..... A63C 9/085

[52] U.S. Cl. ..... 280/625; 280/628; 280/629; 280/634; 280/636

[58] Field of Search ..... 280/625, 626, 628, 631, 280/632, 634, 636

[56] References Cited

U.S. PATENT DOCUMENTS

| | | | |
|---|---|---|---|
| 4,336,956 | 6/1982 | Richert et al. | 280/625 |
| 4,365,822 | 12/1982 | Nitschko et al. | 280/628 X |
| 4,434,997 | 3/1984 | Nitschko | 280/628 |

FOREIGN PATENT DOCUMENTS

| | | | |
|---|---|---|---|
| 2358282 | 6/1974 | Fed. Rep. of Germany | 280/625 |
| 2905837 | 8/1980 | Fed. Rep. of Germany | 280/625 |
| 2948274 | 6/1981 | Fed. Rep. of Germany | 280/626 |
| 3124993 | 3/1982 | Fed. Rep. of Germany | 280/628 |

*Primary Examiner*—David M. Mitchell
*Assistant Examiner*—Mark C. Dukes

[57] ABSTRACT

A laterally releasable toe unit has two laterally pivotable side jaws (11) which are held in a ski boot retaining position by a yoke (26) on which a release spring (30) acts and which can be pivoted laterally while pushing the yoke rearwardly against the spring force to release the ski boot. A toe plate (15) which is movable by a small amount in a vertical direction is arranged behind a laterally fixed toe restrainer (13) and generates, via a force deflection transmission, a longitudinal force which is dependent on the contact force which acts on the toe and which counteracts the spring force via a bar member (12). At least one lever (14) which is acted on by the vertically displaceably or pivotably arranged toe restrainer (13) acts on the same bar member (12) in the same sense with a release force which is dependent on the vertically upwardly directed force acting on the toe restrainer (13).

3 Claims, 2 Drawing Figures

LATERALLY RELEASABLE TOE UNIT FOR A SKI SAFETY BINDING

Figure 1:
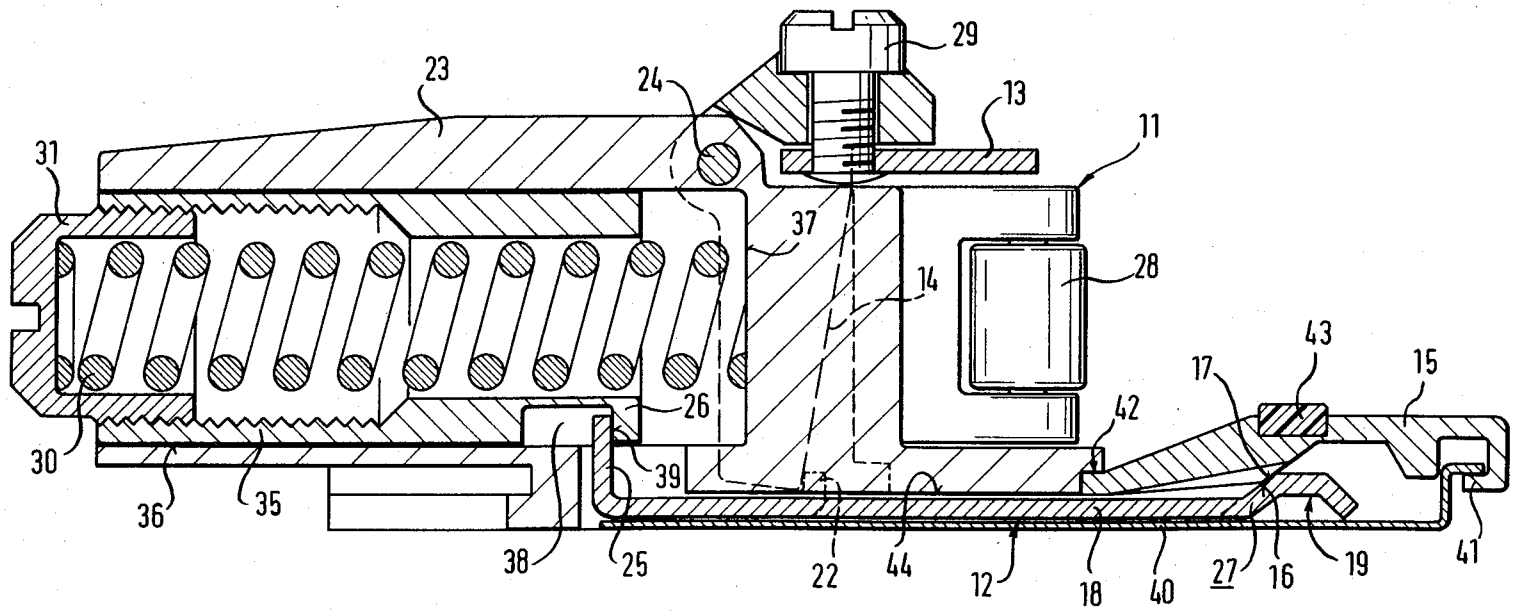

The present invention relates to a laterally releasable toe unit for a ski safety binding for securing a ski boot to a ski.

One known form of toe unit disclosed in German Offenlegungsschrift No. 29 05 837 comprises first and second laterally pivotable side jaws; a yoke for holding said first and second laterally pivotable side jaws in a ski boot retaining position and a release spring having first and second ends one of which bears either directly or indirectly on the yoke to bias the side jaws into the ski boot retaining position. The side jaws are capable of being pivoted laterally against the spring bias to release the ski boot. A toe plate is disposed beneath a toe portion of the ski boot and is movable by a small amount in a direction perpendicular to the ski. A force deflecting transmission acts between the toe plate and the spring to exert a force on the spring against the direction of spring bias, the force being dependent on the contact force acting on the toe plate perpendicular to the upper surface of the ski. The force deflecting transmission includes a bar member extending in the longitudinal direction of the ski. The bar member bears either directly or indirectly on the end of the release spring which bears on the yoke. A toe restrainer restrains upward movement of the toe portion of the boot away from the upper surface of the ski. The sole restrainer is substantially fixedly located in a lateral direction.

Laterally releasable toe units of this kind have the task of compensating during sideways release for the frictional forces present at the front region of the sole of the ski boot which increase when the skier is leaning forwardly. This compensation is obtained because the force of the release spring which acts on the side jaws is partly relieved by the force exerted on the spring against the direction of the spring bias via the toe plate and the bar member. It is important that the bar member acts on the end of the spring which bears on the yoke.

It is also known from German Offenlegungsschrift No. 31 24 993, to arrange the sole restrainer of a laterally releasable toe unit with two laterally pivotable side jaws so that it is vertically displaceable and to direct the upwardly acting force on the toe restrainer to the side jaws via a double-armed lever pivotably connected to a transverse axle on a base member of the binding. With this arrangement, in the event of a rearward position of the skier and a corresponding upwardly directed force on the sole restrainer, the side jaws are loaded in the same sense as they are loaded by the ski boot during lateral release. In this way it is intended to ensure that additional frictional forces occurring between the sole of the ski boot and the sole restrainer during a backward fall are compensated for by reduction of the lateral release force, so that the total force required for lateral release remains approximately constant.

The invention starts from the recognition that it would be expedient if friction compensation were to be affected both for a forward leaning position and also for a rearward position of the skier.

The principal problem underlying the invention is thus to provide a mechanism which is as simply constructed as possible, which is compact and which is at the same time very reliable in operation, and by means of which compensation can be effected for both additional frictional forces between the toe restrainer and the toe of the ski boot with a rearward position of the skier and also for the additional frictional forces acting between the toe of the ski boot and the toe plate in a forward leaning position of the skier.

In order to solve this problem the invention provides, in a ski binding of the initially named kind, that said toe restrainer is displaceable or pivotable in an upward direction away from said ski, and in that at least one lever responsive to an upwardly directed force acting on said toe restrainer acts on said bar member to exert a relief force against said spring bias in the same sense as said force deflecting transmission, said relief force being related to said upwardly directed force.

The thought underlying the invention is thus to be seen in the fact that the bar member already present for friction compensation in a forwardly leaning position of the skier can also be additionally exploited to transmit a relieving force to the yoke or to another part at the relevant end of the release spring when an upwardly directed force acts on the toe restrainer. The transmission ratios of the individual transmissions, i.e. of the force deflecting transmission and of the lever transmission, should be such that the release spring is relieved as closely as possible in proportion to the increasing frictional forces.

The invention is particularly advantageously used with a toe unit in which the bar member has an inclined surface in the vicinity of the toe plate with the inclined surface being acted on by a complementary countersurface on the toe plate. In this case a particularly compact embodiment, which is economic to manufacture, is characterised in that the bar member consists of a central rod carrying at its front end, an upright lug which acts on the yoke and front and rear crossbars of which the rear crossbar has the inclined surface and the front crossbar carries further upright lugs at its ends, wherein said further upright lugs engage behind two substantially vertically arranged levers of the toe restrainer, and wherein said toe restrainer is pivotably connected to an upper portion of a base member of said binding about a transverse axle. The manufacture of this toe unit is made simpler, above all things, by the fact that the bar member can be constructed as a stamped part with bent up lugs and a part carrying the inclined surface. A stamped part of this kind can also be made of very shallow design so as to achieve a compact arrangement. In this way the double friction compensation of the invention can be achieved without a substantial increase in the height of the toe unit.

Above all things the construction of the present invention is able to provide a whole set of bindings with different characteristics. If one only wishes to obtain friction compensation for the forwardly leaning position then one only needs to dispense with the pivotable arrangement of sole restrainer and the force transmission lever, all the other components can remain the same. If one does not wish for friction compensation in the forward leaning position of the skier then one merely needs to replace the movable toe plate by a rigid toe plate as known per se.

The same toe unit can also be constructed without any form of compensation by omitting the bar member, the movable toe plate and the pivotable arrangement of the toe restrainer. This universality is possible because the components required for effecting the compensation do not take up much space and can be compactly accommodated.

Figure 2:
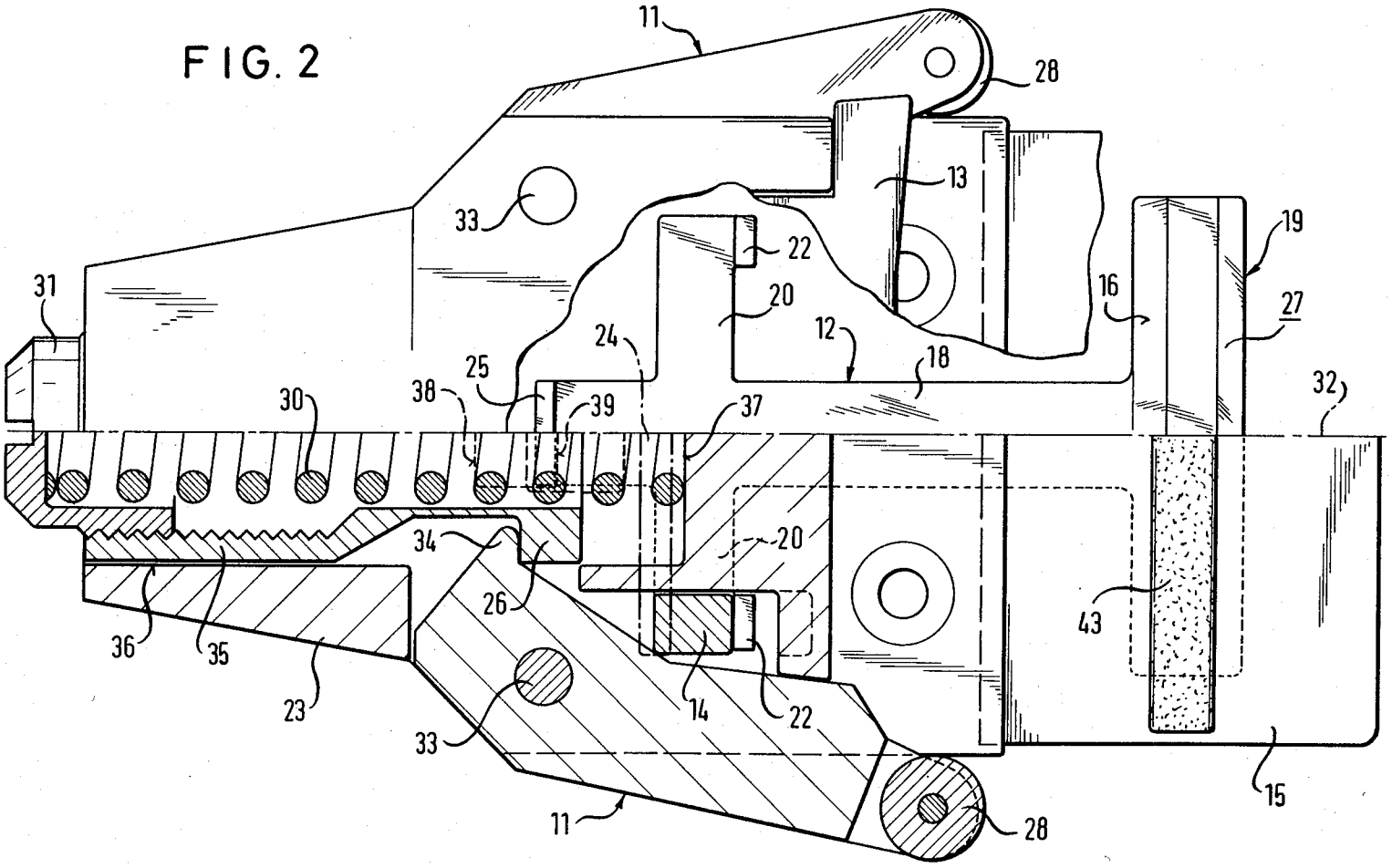

The invention will now be described in more detail by way of example in the following with reference to the accompanying drawings which show:

FIG. 1 a partly sectioned side view of a laterally releasable toe unit having two laterally pivotable side jaws, and FIG. 2 a partly sectioned plan view of the arrangement of FIG. 1.

As seen in the drawing the toe unit of the invention has two, first and second, side jaws 11 which are pivotable about vertical axles 33 arranged on either side of the central longitudinal axis 32 at the same distance therefrom. The longer lever arms of the side jaws each carry at their rear ends rollers 28 which engage with the sole of the ski boot. The shorter lever arms of the side jaws each carry projections 34 which engage in front of a yoke 26 which is formed on a spring cage 35. The construction of the right-hand side of the binding as shown above the central longitudinal axis 32 in FIG. 2 is symmetrical to the construction of the left-hand side as shown beneath the central longitudinal axis in FIG. 2.

The spring cage is axially displaceably arranged in a bore 36 extending in the longitudinal direction of the ski in the base member 23 of the binding. The release spring 30 which is braced at its rear end against an end wall 37 of the base member 23 and at its front end against a bias adjustment screw 31 is located inside the spring cage. The bias adjustment screw 31 can be screwed to a greater or lesser degree into a front end face opening of the spring cage 35.

As a result of this construction the side jaws 11 are held in the ski boot retaining position which can be seen in the drawing. If a lateral force which endangers the skier's leg should act on one of the side jaws 11 the associated projection 34 presses the yoke 26 rearwardly compressing the release spring 30 and a lateral release can take place. A toe restrainer 13 which is pivotable about a transverse axle 24 is arranged in the upper region of the base member 23. The toe restrainer extends between the lever arms of the side jaws which carry the rollers 28 in a region where the front end of the sole of the ski boot is located so that the toe restrainer 13 can secure the ski boot from above when the ski boot is engaged in the binding. The vertical position of the toe restrainer 13 relative to the base member 23 can be adjusted by means of an adjustment screw 29. In this manner the sole restrainer 13 can be matched to various ski boot sole thicknesses.

Two levers 14 extend laterally from the front region of the toe restrainer 13 substantially at right angles to the toe retainer 13 and terminate a relatively small distance above the base of the toe unit. A flat bar member 12 is arranged in a flat hollow cavity 44 in the lower region of the base member 23. In plan view the bar member 12 has approximately the shape of a double cross. It has a central flat rod 18 which terminates at the front end in an upwardly bent lug 25 which engages from below in a recess 38 of the spring cage 35 and which cooperates with an abutment wall 39 extending at right angles to the central longitudinal axis 32. The lug 25 extends at right angles to the rod 18.

In the region of the lever 14 a front crossbar 20 branches off laterally from the central rod 18. The crossbar has two lateral ends which are formed into upright lugs 22. The upright lugs 22 are in force transmitting engagement with the edges of the levers at the lower end thereof.

The central rod 18 extends rearwardly significantly beyond the base member 23 and beneath a toe plate 15 which is provided at its underside with an inclined surface 17. The inclined surface 17 engages with a complementary inclined surface 16 on an upwardly bent inclined surface support part 27 of a further, rear crossbar 19 which is formed at the rear end of the central rod 18 and which is substantially as wide as the front crossbar 20. For stabilisation the rear crossbar 19 can be once again bent downwardly at its rear region. The bar member is covered from below by a shallow closure plate 40. The toe plate 15 is connected with this closure plate 40 at the rear end at 41 so that it can move downwardly relative to the closure plate 40 and relative to the ski. The toe plate 15 is also attached in corresponding manner at the front end at 42 to the base member 23. An upwardly projecting slide strip 43 of a friction reducing material can also be inserted at the upper side of the toe plate 15.

The manner of operation of the toe unit of the invention is as follows:

With a forward leaning position of the skier an increasing downwardly directed force is exerted on the toe plate 15 which exerts a rearwardly directed force on the central rod 18 via the force deflecting transmission formed by the inclined surfaces 16, 17 and the central rod 18. This rearwardly directed force is directed to the yoke 26 via the lug 25. The end of the release spring 30 which acts on the lateral release mechanism is increasingly relieved in accordance with the contact force on the toe plate so that a substantially constant lateral release force is achieved taking account of the increasing frictional force at the toe plate. A corresponding effect occurs when, with a rearward position of the skier, the toe of the ski boot presses increasingly from below against the toe restrainer 13. This upwardly directed force is now transmitted via the levers 14 to the lugs 22 where it likewise exerts a rearwardly directed longitudinal force on the lug 25 via the rod 18. The bar member 12 is thus used for extensive friction compensation both with a forward position and also with a rearward position of the skier.

I claim:

1. A laterally releasable toe unit for a ski safety binding for securing a ski boot to a ski, said toe unit comprising first and second laterally pivotable side jaws; a yoke for holding said first and second laterally pivotable side jaws in a ski boot retaining position; a release spring disposed to bias said yoke in a direction to hold said side jaws in said ski boot retaining position, said side jaws being pivotable laterally against the spring bias to release the ski boot; a toe plate disposed to receive a toe portion of a ski boot thereon, said toe plate being movable in a direction perpendicular to said ski; a force deflecting transmission means operative between said toe plate and said spring for exerting a force on said spring against the spring bias, said force being dependent on a contact force acting on said toe plate perpendicular to said ski, said force deflecting transmission means comprising a bar member extending in the longitudinal direction of the ski and bearing against said yoke; a laterally fixedly located toe restrainer for restraining upward movement of said toe portion away from said ski, said toe restrainer being movable in an upward direction away from said ski; and at least one lever operatively associated with said toe restrainer and responsive to an upwardly directed force acting on said toe restrainer to act on said bar member to move same in a direction to exert a relief force against said spring bias in the same sense as said force deflecting transmission means exerts, said relief force being related to said upwardly directed force.

2. A toe unit according to claim 1, wherein said bar member comprises a central rod having at its front end an upright lug bearing against said yoke and front and rear crossbars; the rear crossbar has an inclined surface in the vicinity of said toe plate and said toe plate has a complementary counter-surface thereon for acting on said inclined surface, the front cross bar has further upright lugs at its ends, and there is a second lever operatively associated with said toe restrainer, said one and second levers being substantially vertically arranged and said further upright lugs engaging behind said levers, and said toe restrainer is pivotably connected to an upper portion of a base member of said binding about a transverse axle.

3. A toe unit according to claim 2, wherein said bar member is formed as a stamped part, said upright lug and further upright lugs being bent-up from said stamped part, and said rear crossbar comprising a portion of said stamped part having said inclined surface thereon.

* * * * *